United States Patent [19]

Gartner

[11] Patent Number: 4,532,746

[45] Date of Patent: Aug. 6, 1985

[54] CORNER JOINT MEANS FOR USE IN WALL STRUCTURE OF BUILDINGS

[75] Inventor: Karl Gartner, Gundelfingen, Fed. Rep. of Germany

[73] Assignee: Yoshida Kogyo K. K., Tokyo, Japan

[21] Appl. No.: 519,197

[22] Filed: Aug. 1, 1983

[30] Foreign Application Priority Data

Aug. 10, 1982 [JP] Japan ..... 57-121467[U]

[51] Int. Cl.[3] ..... E04B 1/00

[52] U.S. Cl. ..... 52/276; 52/573

[58] Field of Search ..... 52/235, 275–278, 52/282, 573; 49/DIG. 1

[56] References Cited

U.S. PATENT DOCUMENTS 3,196,992 7/1965 Owen ..... 52/282

4,100,704 7/1978 Oogami ..... 52/277 X

*Primary Examiner*—Carl D. Friedman

*Attorney, Agent, or Firm*—Hill, Van Santen, Steadman & Simpson

[57] ABSTRACT

There is provided corner joint means which facilitates reliable connection of two wall members placed adjacent to each other at a concave or a convex angle portion i.e., corner portion, in the wall structure of buildings. The corner joint means also provides a simple heat insulating construction at the corner portion of the wall structure. The corner joint means of this invention comprises a pair of foundation assemblies each having one end thereof fixedly connected to the respective wall members, and a plurality of plate-like attachment members spaced in the depth direction of the corner portion and extending between the foundation assemblies. Each of the attachment members is so arranged that one end thereof is fixedly connected to one of the foundation assemblies and the other end thereof is slidably connected to the other foundation assembly.

3 Claims, 5 Drawing Figures

CORNER JOINT MEANS FOR USE IN WALL STRUCTURE OF BUILDINGS

BACKGROUND OF THE INVENTION

1. Field of the Invention

This invention relates to a joint means for connecting wall members constituting a wall structure of a building, such as a curtain wall, and more particularly concerns a corner joint means for connecting two wall members placed adjacent to each other at a concave or convex angle portion in the wall structure.

2. Description of the Prior Art

At present, generally, most wall portions of buildings are constructed with a curtain wall, since the use of the curtain wall makes it possible to greatly reduce the period required for constructing a building and also gives a superior appearance to the exterior of a building. Moreover, most curtain walls can be constructed to incorporate a heat insulating construction filled with suitable heat insulating material.

However, according to the prior art, though it is true that the wall members placed adjacent to one another in a straight portion of the curtain wall construction can easily be connected to one another, it requires extremely tiresome work to connect two wall members that are placed adjacent to one another at a concave or convex angle portion, i.e. corner portions. This is because vertical mullions to be attached to the corner portions must have various sectional configurations conforming to the sectional configuration of the corner portions. Moreover, after completion of attachment of the vertical mullions to the corner portions, there is needed additional work for sealing clearances formed between the mullions and a window unit.

Furthermore, in the prior art, it is difficult to obtain sufficient constructional features, such as earthquake-proofing, water proofing or wind pressure-proofing, for the corner portion of the curtain wall which needs to be constructed on site. In particular, providing sufficient heat insulating treatment to the corner portion of a curtain wall incorporating a heat insulated construction calls for extremely time-consuming and troublesome work.

SUMMARY OF THE INVENTION

It is, accordingly, an object of the present invention to overcome the disadvantages in the conventional construction of the corner portion where two wall members are to be connected, by providing a corner joint means which facilitates reliable connection of two wall members placed adjacent to one another at a corner position.

Another object of this invention is to provide a corner joint means having simple heat insulating construction.

According to one of the preferred embodiments of the present invention, a corner joint means for connecting two wall members placed adjacent to each other at a corner portion of the curtain wall construction of a building comprises a pair of foundation assemblies each fixedly connected at one end thereof to the associated wall member, and three plate-like attachment members spaced in the depth direction of the corner portion, each of the three attachment members being arranged so that one end thereof is fixedly connected to one of the foundation assemblies while the other end thereof is slidably connected to the other foundation assembly.

In another embodiment of the invention, the corner joint means includes heat insulating material provided within cavities defined by the attachment members.

DESCRIPTION OF THE PREFERRED EMBODIMENT

Figure 1:
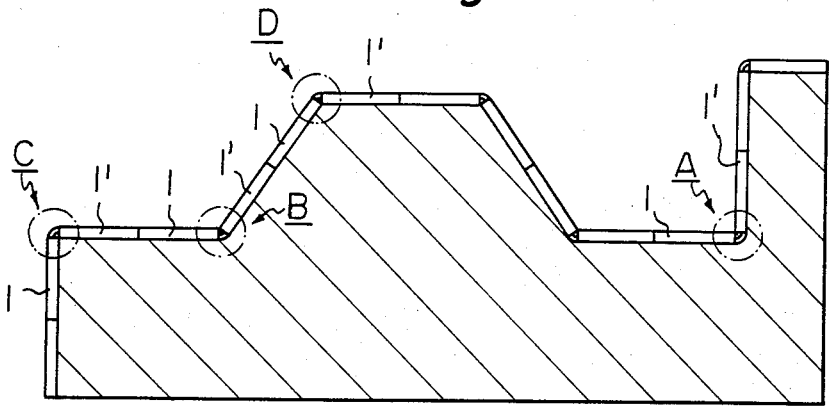
FIG. 1 is a diagrammatic top plan view of a building provided with a curtain wall construction including wall members connected by corner joint means of the invention at corner portions A, B, C and D.

FIG. 1 is a diagrammatic top plan view of a building provided with a wall construction, such as curtain walls or window walls, consisting of wall members. Reference characters 1 and 1' indicate a pair of wall members which are placed adjacent to each other at a concave angle portion A or B and a convex angle portion C or D of the wall construction. (The concave and the convex angle portions will hereinafter be referred to simply as corner portions.)

Referring to FIGS. 2 to 5 wherein like or corresponding parts are designated by the same reference, they show enlarged sectional views of the corner portions A, B, C and D in FIG. 1, respectively. A corner joint means positioned between two wall members 1, 1' disposed adjacent to each other at a predetermined angle includes a pair of foundation assemblies 2 and 2' spaced from each other with one end thereof connected to the respective associated wall members 1, 1', an outer attachment member 19, an intermediate attachment member 6, and an inner attachment member 5. Each attachment member extends between the two foundation assemblies 2 and 2' to define the space formed between the two wall members. Preferably, as shown in the drawings, the corner joint means has a heat insulating construction with the cavities 12 between the attachment members filled by heat insulating material 21, 21'.

Foundation assembly 2 includes an inner member 3, an outer member 18, a batten 10 connected to the inner member 3, and an insulation member 22 positioned between the batten 10 and the outer member 18. The members 3, 10, 18 and 22 are combined together by means of connection bolts (not shown). It is preferable that the foundation assembly 2 includes a plate member 25 of heat insulating material which is clamped between the batten 10 and outer member 18.

The outer member 18 and the batten 10 have engaging grooves 20, 11, respectively, each opening toward the foundation member 2' for slidably receiving the ends of respective attachment members 6, 19.

The inner member 3 is preferably formed as an integral hollow body having a generally rectangular section by extruding light metal, such as aluminum or aluminum alloy. In the embodiment shown in the drawings, the inner member 3 includes a heating medium passage 7 having a circular section for permitting passage of a heating medium, such as warm water or cold water, and an air passage 8 having a substantially rectangular section for permitting passage of air heated or cooled by the heating medium.

The inner member 3 has an attachment piece 9 in its inner end which protrudes toward the foundation assembly 2'. In the embodiment shown in FIGS. 2 to 4, a connecting piece 30 is connected to the attachment piece 9 by a stud bolt.

Figure 3:
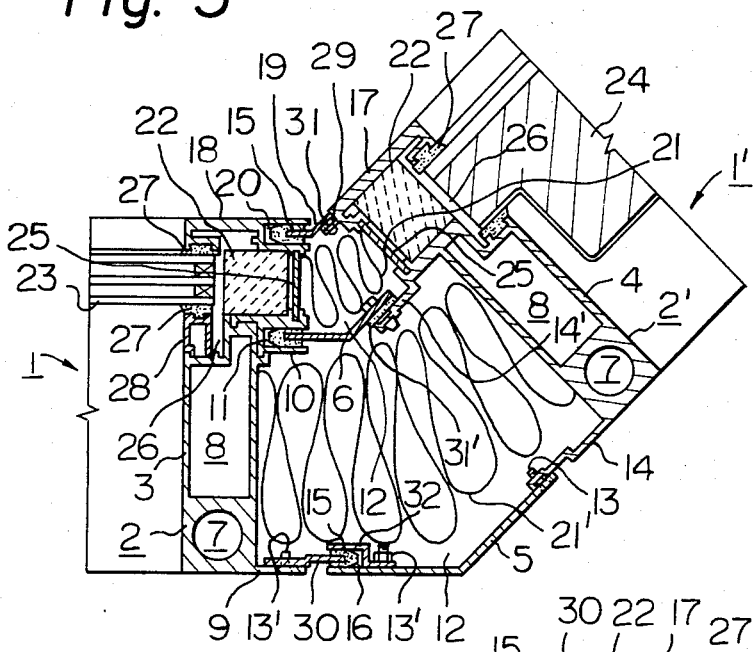
FIG. 3 to FIG. 5 are enlarged sectional views of corner portions B, C and D in FIG. 1, similar to FIG. 2.

A recess 26 formed between the inner and the outer members accomodates a pair glass 23 or a panel 24 supported by packing members 27 and/or an attachment 28 (FIG. 3).

The foundation assembly 2' includes an inner member 4, an outer member 17, and an insulating member 22 positioned between the members 4, 17. The members 4, 17 and 22 are combined together by bolts (not shown). Preferably, and in a similar manner to the foundation assembly 2, the foundation assembly includes a plate member 25 of heat insulating material clamped between the inner and the outer members.

The inner member 4, which is formed as a hollow body having a substantially rectangular section similar to the inner member 3, has a heating medium passage 7 of a circular section and an air passage 8 positioned on the outer side of the passage 7.

Figure 2:
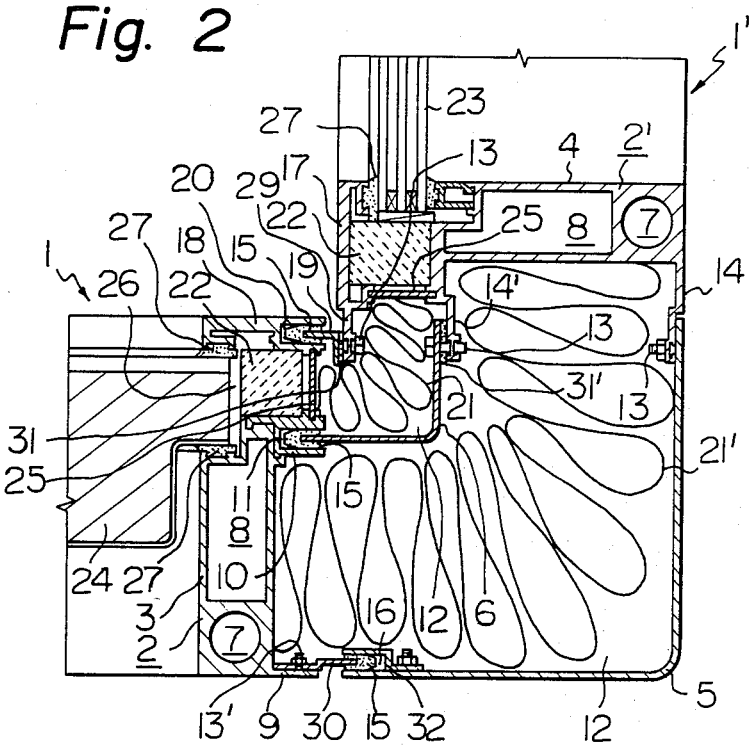
FIG. 2 is an enlarged sectional view of a corner portion A in FIG. 1 wherein two wall members placed adjacent to each other are connected by means of a corner joint means of the invention.
Figure 4:
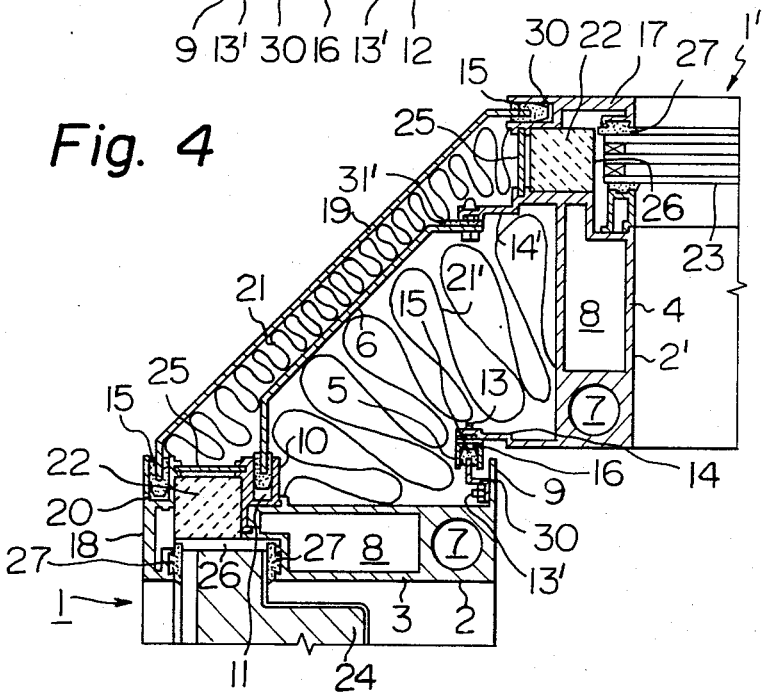
Figure 5:
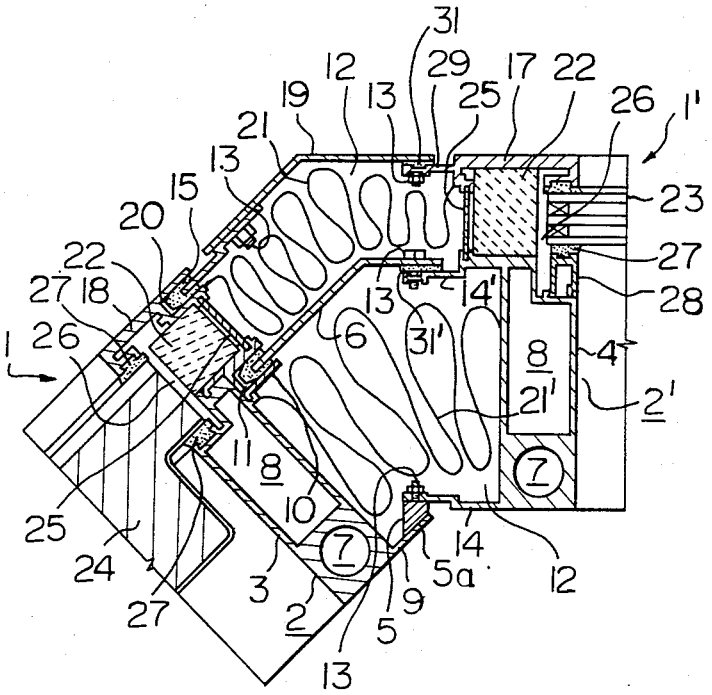

In the embodiment shown in FIGS. 2, 3 and 5, the outer member 17 is formed with an attachment piece 29 at one end thereof which protrudes toward the foundation assembly 2 for securing one end of the outer attachment member 19 thereto. In the embodiment shown in FIG. 4, the outer member 17 has an engaging groove 30 at one end thereof which opens toward the foundation assembly 2 for slidably receiving one end of the outer attachment 19.

The aforementioned attachment members 5, 6 and 19 extending between the foundation assemblies 2, 2' are formed by bending plates of corrosion resistant material, such as aluminum sheet or stainless steel sheet, so that they can coincide with the configuration of the corner portion.

One end of the outer attachment member 19 is secured to the attachment piece 29 of the outer member 17 by means of a bolt 13 with sealing member 31 interposed between the members 19 and 29. The other end of the outer attachment member 19 having sealing material 15 is slidably received in the engagement groove 20 of the outer member 18 of the foundation member 2.

In the embodiment shown in FIG. 4, both ends of the outer attachment member 19 having sealing material 15 are slidably received in the respective grooves 30, 20 of the outer members 17, 18, respectively.

The intermediate attachment 6, like the outer attachment 19 shown in FIGS. 2, 3 and 5, is secured to the foundation assemblies 2 2' with one end thereof connected to an attachment piece 14' of the inner member 4 together with a sealing 31' by means of a bolt 13, and the other end thereof having sealing material 15 slidably received in the groove 11 of the batten 10.

One end of the inner attachment member 5 is secured to the attachment piece 14 by means of a screw 13 as shown in FIGS. 2 to 5. The other end of the inner attachment member 5 is adapted for slidably engaging with the attachment piece 9 of the inner member 3.

While various modifications can be considered in order to accomplish the slidable engagement of the other end of the inner member 5 with the foundation assembly 2 through the attachment piece 9, in the embodiment shown in FIGS. 2 and 3, there are provided an engagement piece 32, having an L-shaped portion with one end thereof screwed to the other end of the inner attachment member 5, and a connecting piece 30, with one end thereof having a sealing material 15 and the other end thereof connected to the attachment piece 9 of the inner member 3 by means of a stud bolt 13'. The inner attachment member 5 slidably engages with the foundation assembly 2 by receiving the connecting piece 30 having sealing material 15 in an engaging groove 16 formed at the other end of the inner attachment member 5.

In the embodiment shown in FIG. 4, the inner attachment member 5 is formed to have an inverted U-shaped configuration defining an engaging groove 16 therein. The engaging groove 16 slidably receives the connecting piece 30 having sealing material 15.

In the embodiment shown in FIG. 5, the inner attachment member 5 is provided with a slope **5*a* slidably engaging with the attachment piece 9**.

As indicated above, since at least one end of each of the attachment members 5, 6 and 19 is slidably connected to the foundation assembly, the corner joint means of the invention is able to accommodate relative displacement between the wall members which may be caused by difference in temperature, earthquake, or wind pressure. Further, the slidable engagement of the attachment members with the foundation assembly allows for inaccuracy in alignment during the construction of buildings.

Though various materials can be used as the heat insulating member 21, 21', it is preferable to use a soft material, such as glass wool or rock wool, which is deformable in correspondence with the relative displacement between the wall members 1, 1'.

As it will be apparent from the foregoing, according to the invention, there is provided a corner joint means which facilitates easy connection of two wall members disposed adjacent to one another at various corners of different angles.

The invention also provides a heat insulative, water sealed and quake resistant corner joint means.

What is claimed is:

1. A corner joint means for connecting two wall members disposed adjacent to one another at a corner portion of a curtain wall construction of a building comprising a pair of foundation assemblies each having one end thereof fixedly connected to the associated wall member, and a plurality of separate plate-like attachment members spaced apart from each other in the depth direction of said corner portion and extending between said foundation assemblies so as to define therebetween a corner space enclosed between said two wall members, wherein one end of each attachment member is fixedly connected to one of said foundation assemblies while the other end of each attachment member is slideably connected to the other of said foundation assemblies.

2. A corner joint means according to claim 1 wherein said foundation assemblies comprise hollow members.

3. A corner joint means according to claim 1 wherein cavities defined between said attachment members are filled with heat insulating material.

* * * * *